US005235313A

United States Patent [19]

Narizuka et al.

[11] Patent Number: 5,235,313

[45] Date of Patent: Aug. 10, 1993

[54] THIN FILM RESISTOR AND WIRING BOARD USING THE SAME

[75] Inventors: Yasunori Narizuka, Hiratsuka; Syoozi Ikeda, Yokohama; Akira Yabushita, Yokohama; Masakazu Ishino, Yokohama; Juichi Kishida, Yokohama, all of Japan

[73] Assignee: Hitachi, Ltd., Tokyo, Japan

[21] Appl. No.: 723,608

[22] Filed: Jul. 1, 1991

[30] Foreign Application Priority Data

Jun. 29, 1990 [JP] Japan ..... 2-170043

[51] Int. Cl.[5] ..... H01C 1/012

[52] U.S. Cl. ..... 338/308; 338/309; 204/192.1; 427/101; 437/60

[58] Field of Search ..... 338/309, 308, 313, 314; 437/60, 106, 109, 918; 118/715; 427/101, 102, 103; 204/192.1, 192.11

[56] References Cited

U.S. PATENT DOCUMENTS 3,765,940 10/1973 Hentzchel ..... 437/106
4,392,992 7/1983 Paulson et al. ..... 338/309
4,467,519 8/1984 Glang et al. ..... 437/60
4,510,178 4/1985 Paulson et al. ..... 427/102 X
4,591,821 5/1986 Paulson et al. ..... 338/308

*Primary Examiner*—Marvin M. Lateef
*Attorney, Agent, or Firm*—Antonelli, Terry, Stout & Kraus

[57] ABSTRACT

A thin film resistor having a characteristic that an increase phenomenon of a resistance controlled at a high temperature is generated. The resistor is obtained by controlling it composition and manufacturing method so as to suppress an increase in the resistance of a Cr-Si resistor thin film due to deposition of chromium silicide at a high temperature. A sputtering target, which is used as a raw material for forming the thin film, is made from chromium silicide and silicon so that some chromium silicide is already formed immediately after deposition, and chromium oxide and silicon oxide are contained in the thin film so as to suppress the speed whereat chromium and silicon, which do not form silicide, form silicide by heating after deposition and to allow the above silicide formation to advance slowly.

14 Claims, 10 Drawing Sheets

THIN FILM RESISTOR AND WIRING BOARD USING THE SAME

BACKGROUND OF THE INVENTION

The present invention relates to a thin film resistor which is used, for example, as a thermal head heating resistor for a printer or facsimile equipment or a resistor element of a high density wiring board which is mounted in an electronic computer.

A thin film resistor formed from metallic chromium, metallic silicon, or silicon oxide, which has a high heat resistance and power resistance, is indicated in Japanese Patent Application Laid-Open No. 58-84401. Furthermore, a thin film resistor formed from metallic chromium, metallic silicon, silicon oxide, or chromium oxide, which has more improved characteristics than the above thin film resistor, is indicated in Japanese Patent Application Laid-Open No. 59-94393.

In an example indicated in Japanese Patent Application Laid-Open No. 58-84401, as shown in FIG. 1, when a thin film is heated and cooled, chromium and silicon contained in the above thin film combine with each other to form chromium silicide within a temperature range from 350 to 450° C. The resistivity of the thin film increases suddenly as shown by numeral 3 in FIG. 1 as the deposition phenomenon advances.

Therefore, when the above thin film is to be used at high temperatures or applied with high power which may generate heat, the thin film is required to be subjected to heat treatment for sufficient stabilization during production, for example, treatment at 350° C. for one hour.

In FIG. 1, numerals 2, 3, 4, 5, and 6 indicate the path order of resistance changes in the heating and cooling cycle and 1 the minimum value of the above resistance changes. The above phenomenon that the resistivity suddenly increases has an advantage that the resistor element is prevented from overheating by an increase in the resistivity when overpower is applied. There is a problem imposed that this phenomenon advances slowly in the normal operation stat so as to change the resistance. In an example indicated in Japanese Paten Application Laid-Open No. 59-94393, the resistance does not increase because chromium oxide existing in the film suppresses the above phenomenon for forming chromium silicide, a resistor thin film in the usable state can be formed by heat treatment at a comparatively low temperature, and the resistance changes little in the normal operation state. However, there is a problem imposed that care is required for use at a constant voltage because the resistance decreases continuously when overcurrent is applied.

SUMMARY OF THE INVENTION

The object of the present invention is to solve the above problems of the prior art and to provide a thin film resistor which has a characteristic that it is hardly destroyed not only in the normal operation state but also when incidental overcurrent is applied.

To accomplish the above object, the composition and manufacturing method of a thin film resistor are optimized so as to realize a characteristic that the resistor increases under control at a high temperature.

So as to control a Cr-Si resistor thin film from an increase in resistance due to deposition of chromium silicide at a high temperature, a sputtering target, which is a raw material of the thin film, is made from chromium silicide and silicon so that some chromium silicide is already formed immediately after deposition. Chromium oxide and silicon oxide are contained in the thin film so as to suppress the speed whereat chromium and silicon, which do not form silicide, form silicide by heating after deposition and to allow the above silicide formation to advance slowly. By these treatments, the resistivity increase characteristic at a high temperature is improved, the stability at a high temperature is increased, and sudden degradation of a resistor thin film due to overcurrent can be prevented.

DESCRIPTION OF THE PREFERRED EMBODIMENTS

First, the first embodiment of the present invention will be described with reference to the accompanying drawings.

Figure 3:
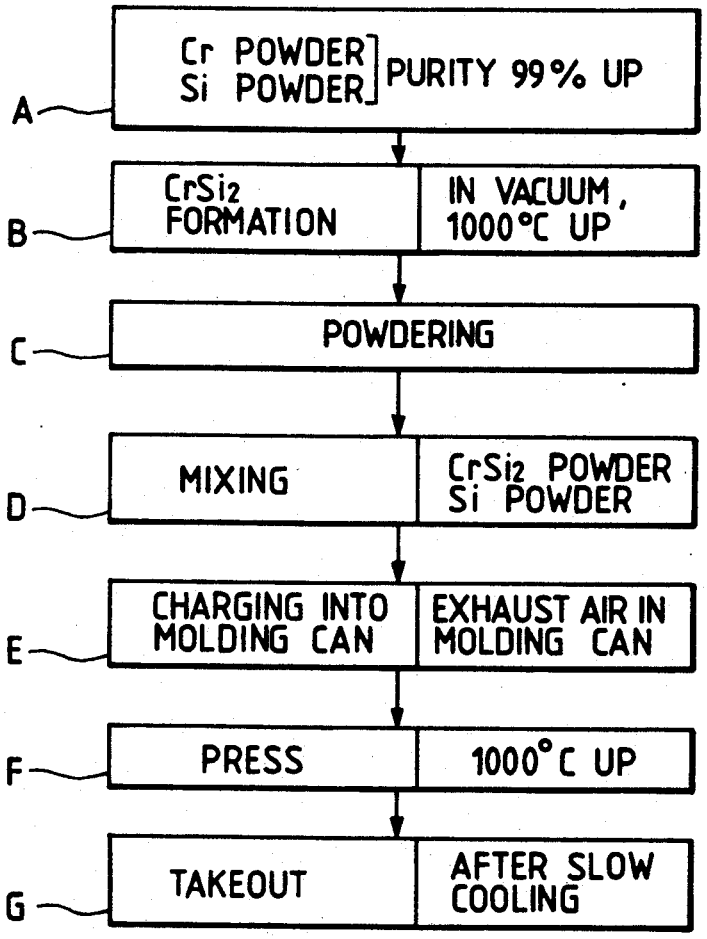
FIG. 3 is a drawing showing the production process for a sputtering target of the present invention.

From the processes from A to G as shown in FIG. 3, a uniform target containing $CrSi_2$ and Si is manufactured by the sintering method using powder of chromium disilicide ($CrSi_2$) and silicon (Si), which are mixed at a desired compounding ratio, as a raw material. By using the target, a resistor thin film about 10 nm in thickness is deposited on a ceramic substrate coated with glass by the DC conventional sputtering method. Such a film can be formed by the RF sputtering method. However, the RF sputtering method requires care when it is used for forming a resistor thin film because film characteristics caused by the structure of a film forming apparatus are distributed outstandingly.

Figure 5:
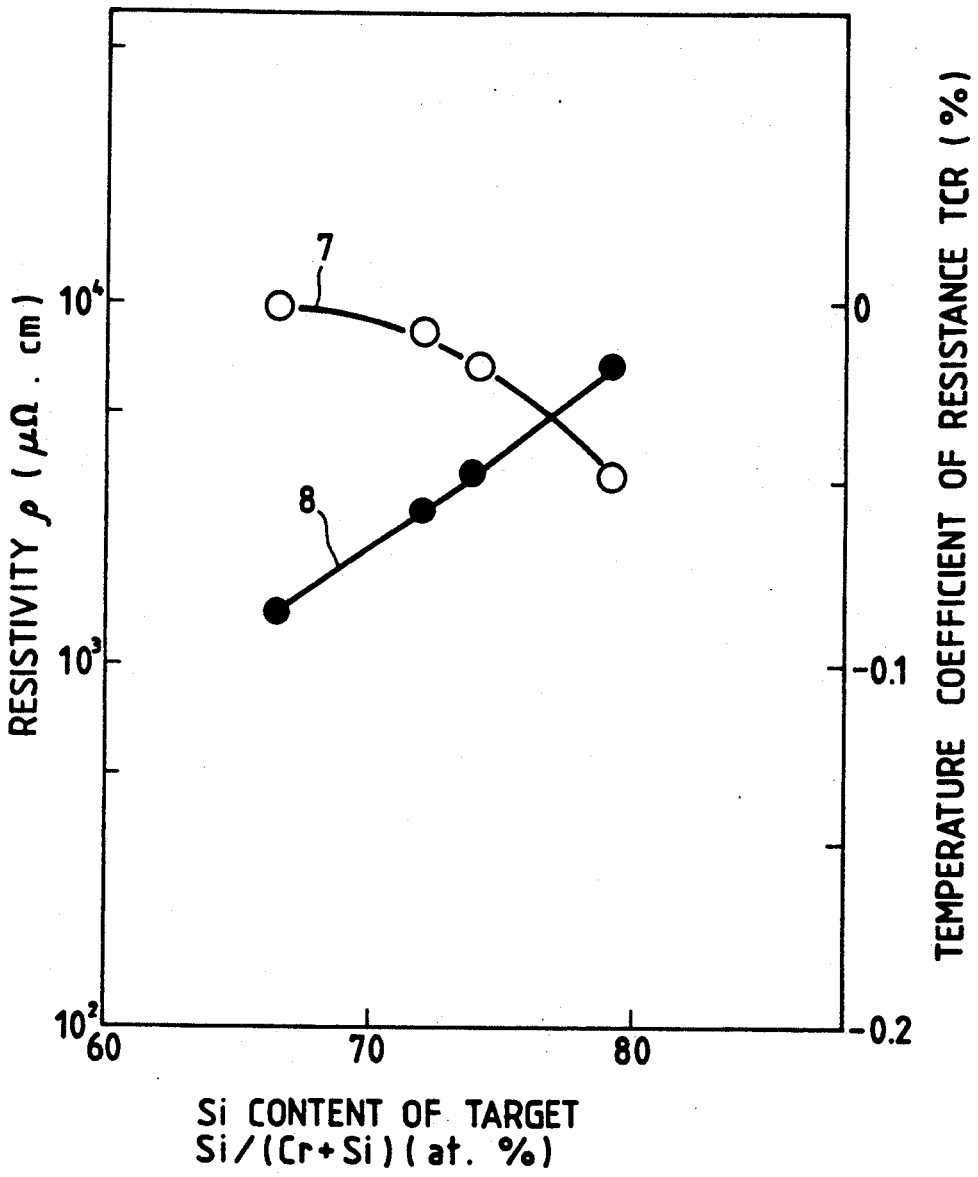
FIG. 5 is a drawing showing the dependency of the resistivity and temperature coefficient of resistance of a thin film of the present invention on the sputtering target composition.

FIG. 5 shows the relationship between the resistivity 8 and temperature coefficient of resistance 7 of a resistor thin film formed by the above method and the Cr/Si ratio in the target.

Figure 4:
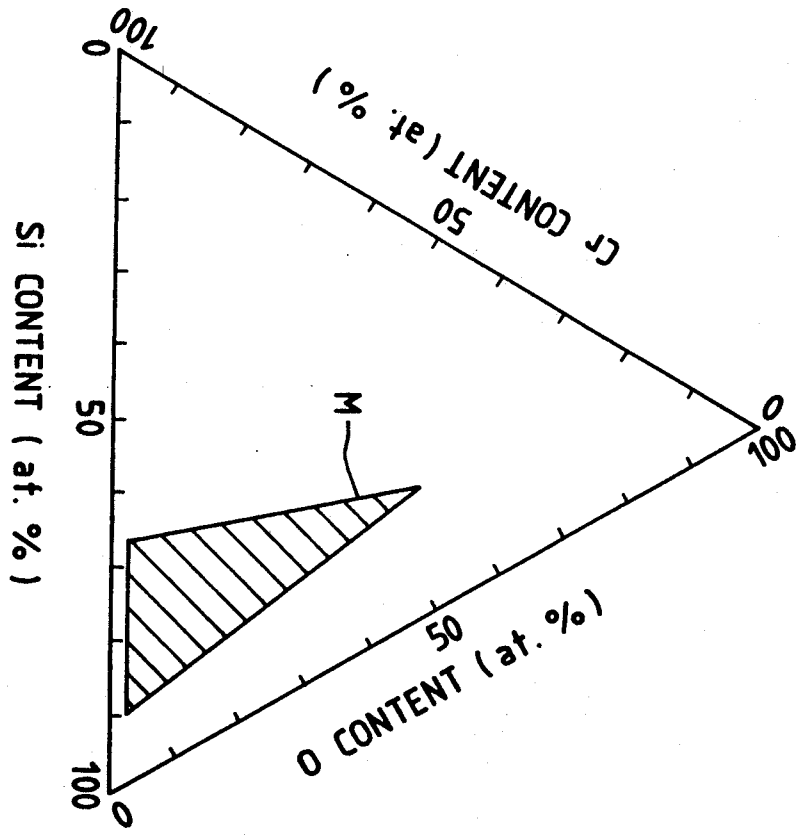
FIG. 4 is a drawing showing the composition of a thin film of the present invention.

FIG. 4 is a Si-Cr-O system ternary composition diagram showing the composition of a thin film of the present invention, and a symbol M indicates the composition range of a thin film of the present invention.

Next, the second embodiment will be described hereunder. The resistor thin film formed by the above first embodiment is heat-treated at 300 to 350° C. in a vacuum. An electrode thin film of two layers of chromium and aluminum or of three layers of chromium, copper, and chromium is formed on the resistor thin film, and then a wiring pattern is formed by the photoetching technique. The resistor thin film formed by the above method can be easily etched by an etching solution containing a fluoric acid. Since the thin film is hardly corroded by acids other than it, selective etching can be done more easily. The reason for the heat treatment which is performed after deposition in the present invention is as follows: When general metallic silicide has a composition that the ratio of the number of atoms of silicon to that of metal is more than 2, a phenomenon that the texture is separated into metal disilicide and silicon by heating in atmosphere after deposition or by heating after an electrode metallic layer is formed and Si is cohered on the thin film surface or on the interface with the substrate is well known. By this phenomenon, problems such that Si diffuses into the electrode metal or the apparent sheet resistance changes greatly are caused. So as to avoid such problems, a satisfactory resistor element can be obtained. When this treatment is not performed, a $CrSi_2$ layer with low resistivity is formed by diffusion of Si into the chromium thin film of the electrode and the sheet resistance of the resistor thin film decreases after the chromium layer is removed. This phenomenon can be prevented by the above heat treatment.

Figure 6:
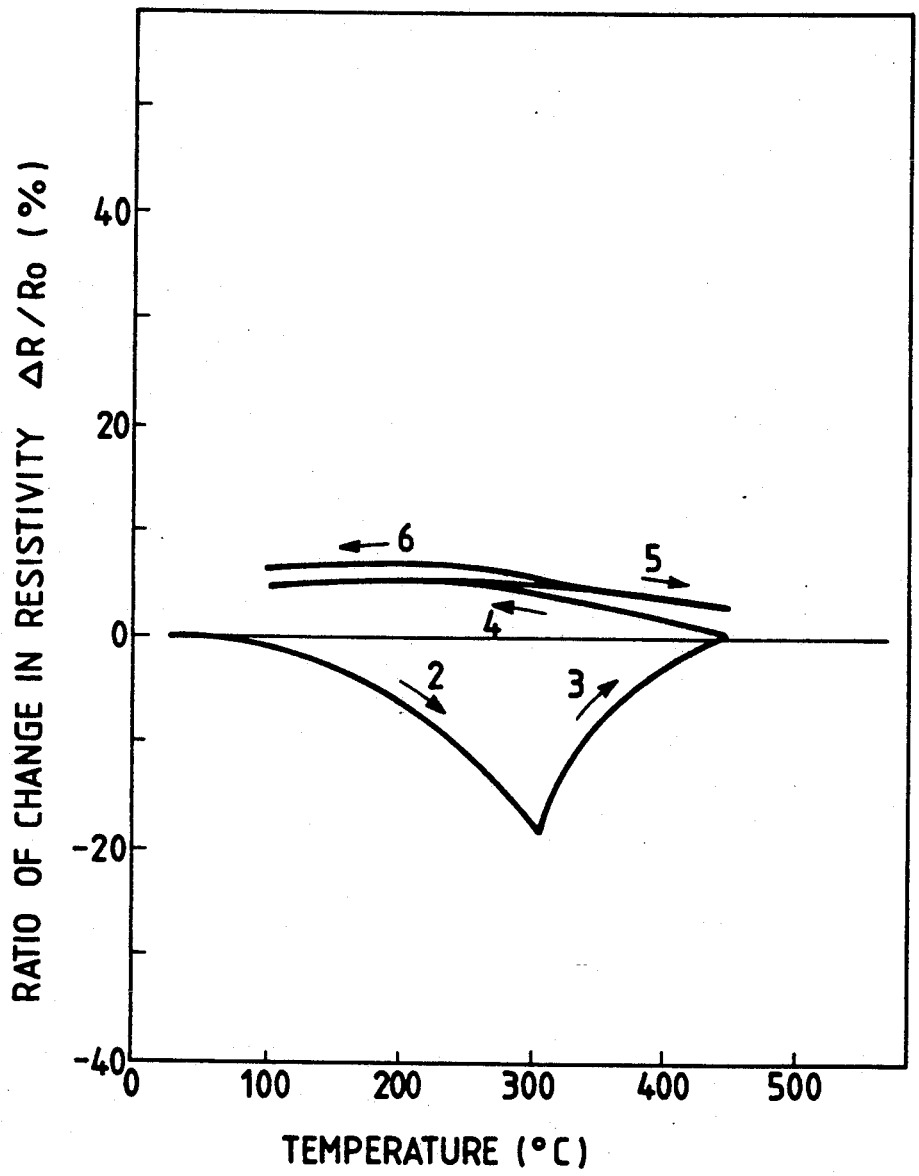
FIG. 6 is a drawing showing changes in the resistance of the present invention by heating and cooling.

Next, the third embodiment will be described. When changes in the resistivity of the resistor thin film formed by the first embodiment is observed by heating the thin film at a predetermined temperature rising speed, an increase 3 of the resistance is small compared with that of a resistor thin film indicated in Japanese Patent Application Laid-Open No. 58-84401 as shown in FIG. 6, though it is not eliminated as indicated in Japanese Patent Application No. 59-94393.

Figure 7A:
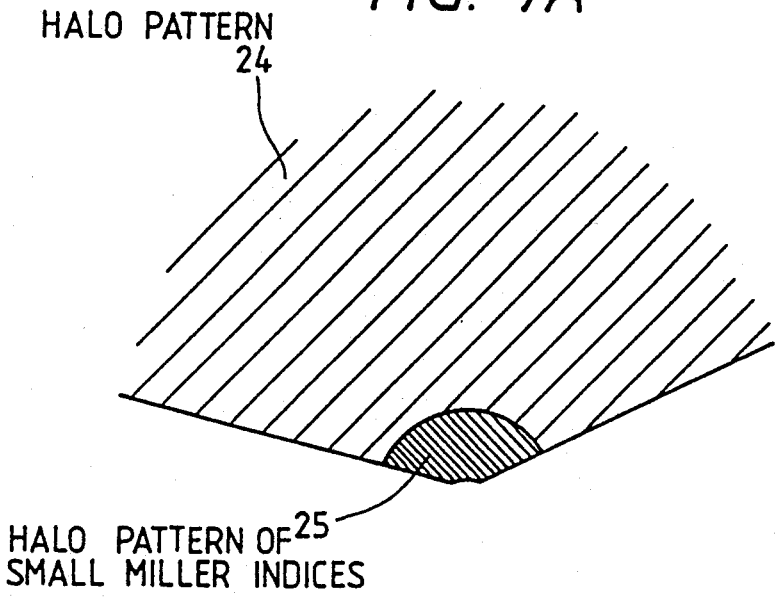
FIG. 7A is a drawing showing a high energy electron beam diffraction image of a thin film of the present invention after deposition.
Figure 7B:
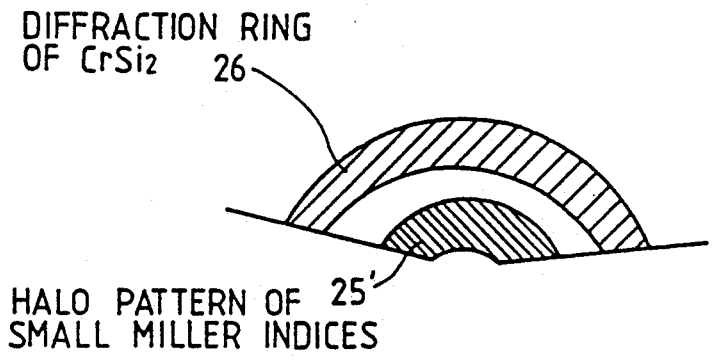
FIG. 7B is a drawing showing the above image after heat treatment.

So as to examine the reason for such characteristics, a resistor thin film immediately after deposition and a resistor thin film after heat treatment are subjected to high energy electron beam diffraction analysis. FIGS. 7A and 7B show diffracted pattern images 25 and 25' obtained from the above analysis. A ring indicating $CrSi_2$ is observed in the thin film immediately after deposition and a more clear ring is observed in the thin film after heat treatment. Therefore, the possible reason why the resistance of this resistor thin film increases comparatively small is that since CrSi2 which is a stable phase exists already, subsequent changes are controlled.

The reason why such a stable phase exists already unlike a conventional resistor thin film is that $CrSi_2$ is used as a main raw material of the sputtering target. The resistance increase phenomenon 3 starts at a temperature lower than that of a conventional resistor thin film. This is a change caused by a phenomenon that the ratio of the number of atoms of silicon to that of chromium is more than 2, and the resistor element can be prevented from degradation by overpower earlier because the resistor begins to increase at an early stage of application of the overpower.

Next, the fourth embodiment of the present invention will be described. An electro migration preventive layer of silicon dioxide ($SiO_2$) is formed on a resistor thin film formed by the first and second embodiments. A thermal head is produced from the thin resistor and subjected to a step-up stress test so as to examine the power resistance thereof.

Figure 8:
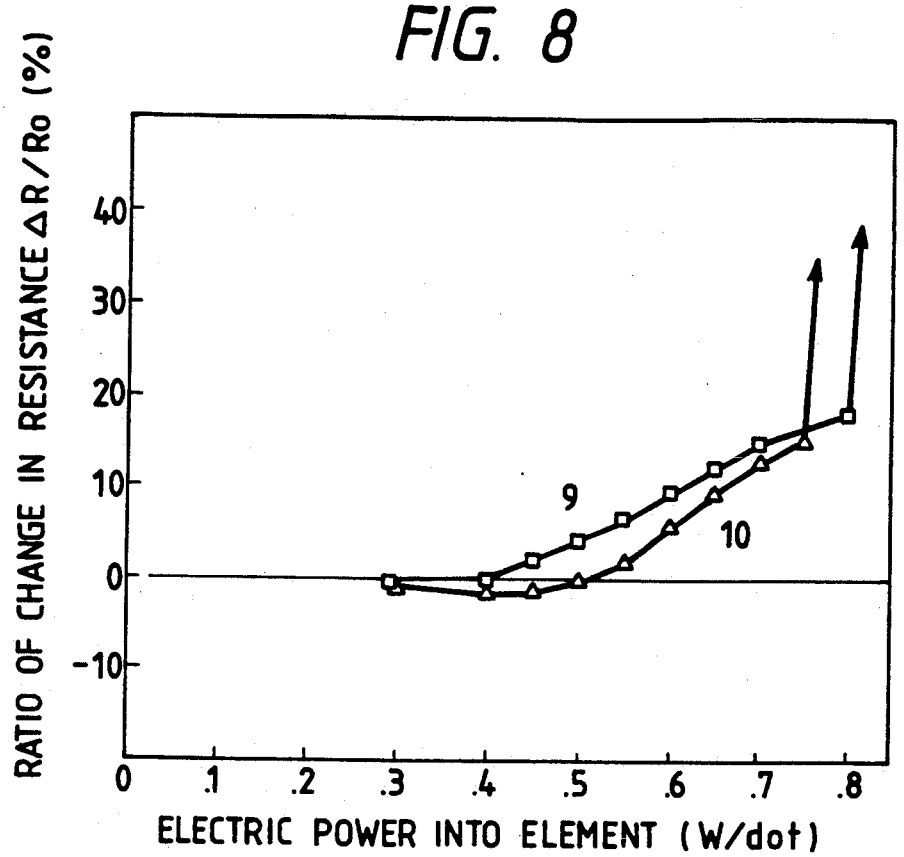
FIG. 8 is a drawing showing the power resistance of a thin film of the present invention which is used as a thermal head.
Figure 9:
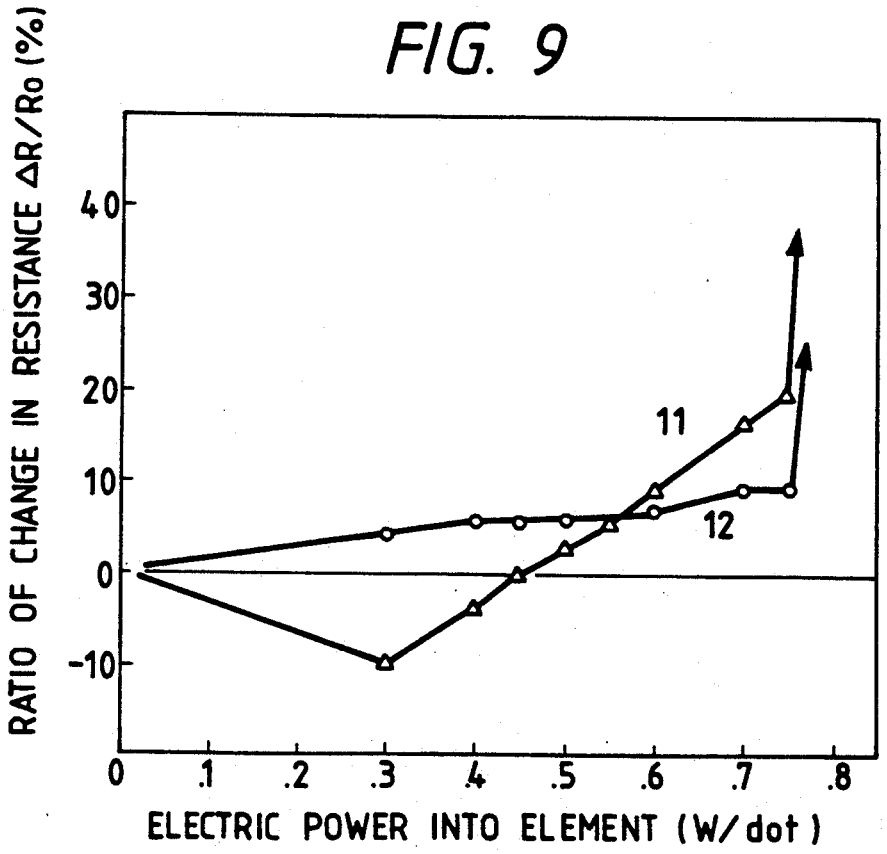
FIG. 9 is a drawing showing the power resistance of a thin film of the present invention which is not aged before use.

The test shows that the above resistor thin film has power resistance equivalent to that of a conventional resistor thin film 9 indicated in Japanese Patent Application Laid-Open No. 58-84401 as shown in FIG. 8. A test conducted with a resistor thin film which is not heat-treated shows that the thin film has sufficiently stable characteristics as shown in FIG. 9. The power resistance 10 of a resistor thin film of the present invention is superior to that of a conventional resistor thin film in this respect.

In FIG. 9, numeral 11 indicates the power resistance of a conventional thin film which is not aged and 12 the power resistance of a thin film of the present invention which is not aged. The drawing shows that in addition to the characteristics described in the third embodiment, the existence of chromium oxide and silicon oxide suppresses electro migration of the elements forming the resistor thin film and minimizes degradation of the resistor thin film by the electro migration. Since an electro migration preventive layer of silicon compound is well adhered to a resistor thin film, the layer is not separated and fallen before the resistor element is destroyed in the above test which causes thermal expansion and the degradation of the resistor element by electro migration can be minimized.

Figure 10:
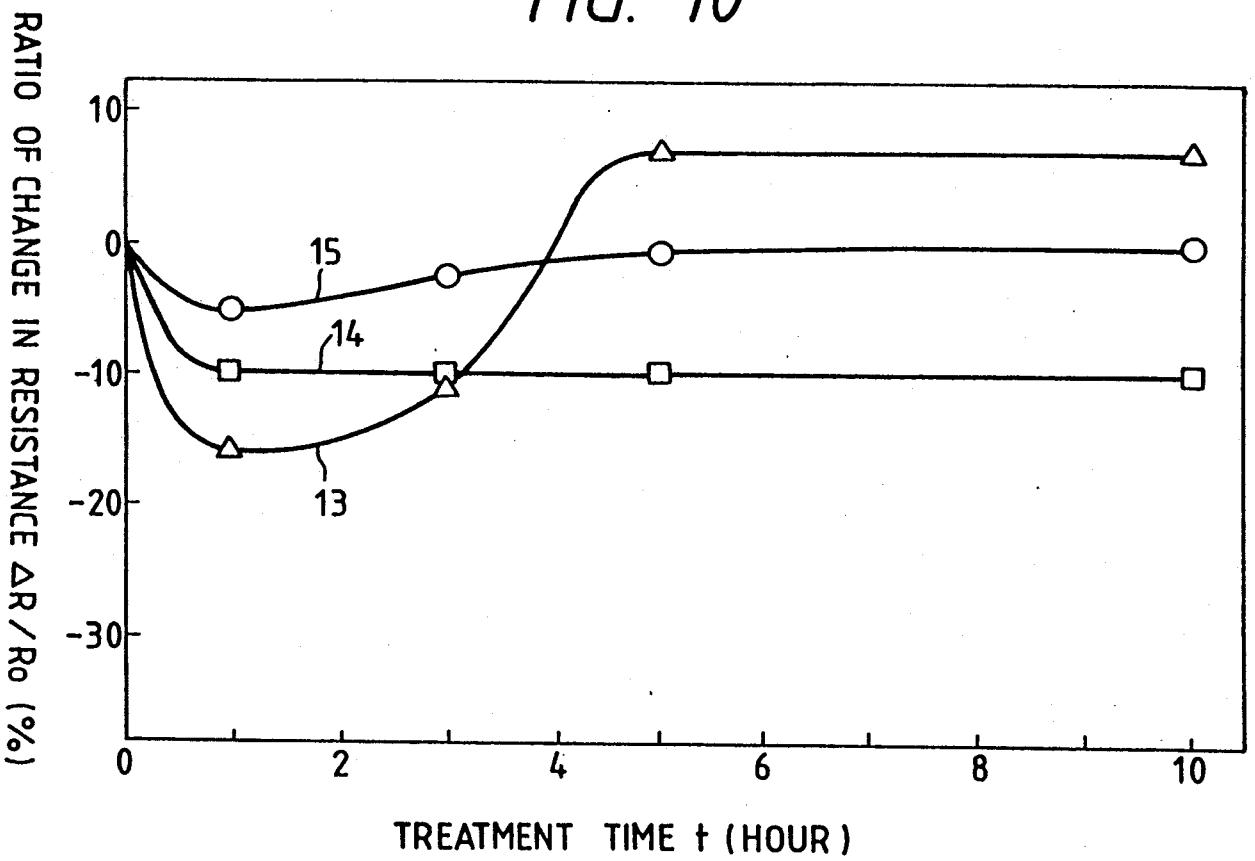
FIG. 10 is a drawing showing changes in the resistance with time during treatment at a high temperature

Next, the fifth embodiment will be described. FIG. 10 shows changes in the resistivity when the thin film formed in the first embodiment is treated at 350° C. in atmosphere. The result shows that the resistivity change 15 of the resistor thin film of the present invention at a high temperature indicates intermediate behavior of the resistivity changes 13 and 14 of conventional thin films at a high temperature and is most stable. This is caused by the reason described in the third embodiment.

Figure 11A:
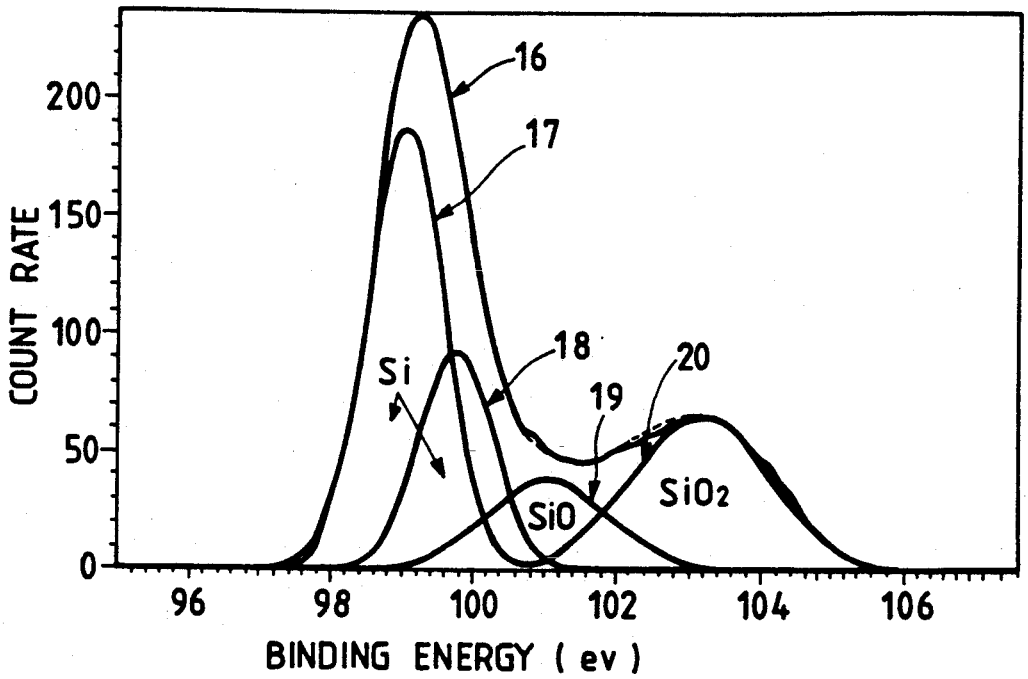
FIG. 11A is a drawing showing the peaks of silicon thin films by the X-ray photoelectron spectroscopy (XPS) and the peak separation result.
Figure 11B:
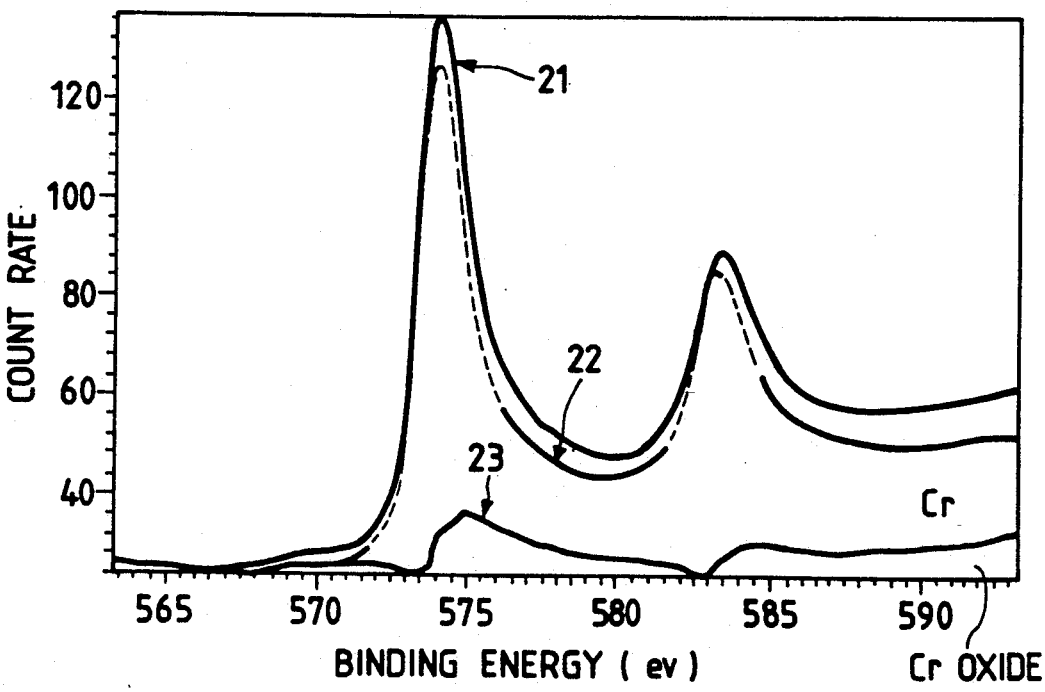
FIG. 11B is a drawing showing the peaks of Cr and the peak separation result in the same way as in FIG. 11A.

Next, the sixth embodiment will be described. FIGS. 11A and 11B show results of the X-ray photoelectron spectroscopy with resistor thin films of the present invention. In FIG. 11A, numeral 16 indicates the detected peak of silicon, 17 the detected peak of metallic silicon, 18 the detected peak of silicide, 19 the detected peak of silicon oxide (SiO), and 20 the detected peak of silicon oxide ($SiO_2$). In FIG. 11B, numeral 21 indicates the detected peak of chromium, 22 the detected peak of metallic silicon, and 23 the detected peak of chromium oxide.

Figure 1:
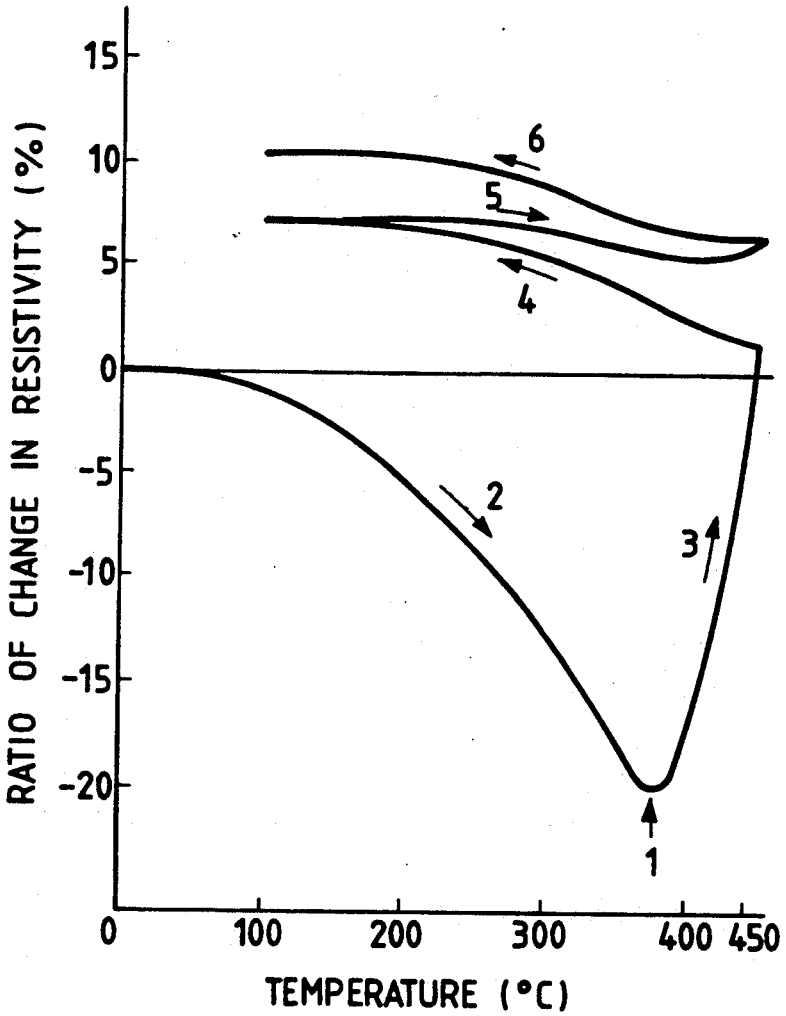
FIG. 1 (PRIOR ART)
FIGS. 1 and 2 are drawings showing changes in the resistance by heating and cooling using the prior art.
Figure 2:
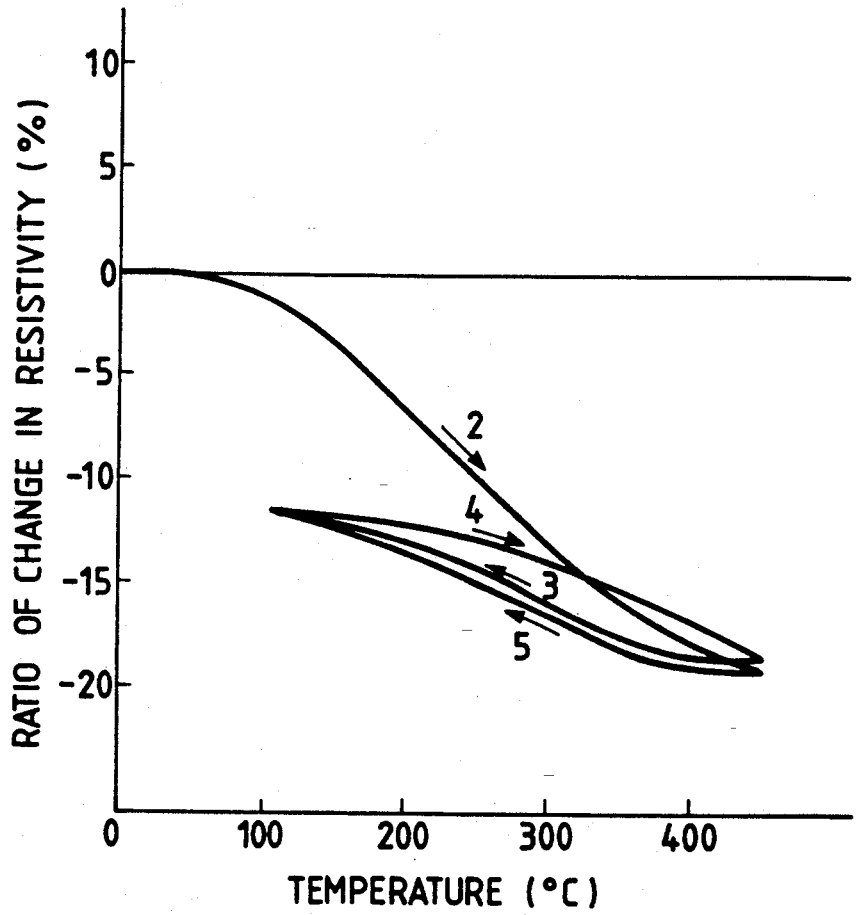
FIG. 2 (PRIOR ART)

FIGS. 11A and 11B show chemical states of Si and Cr in thin films, which are divided into two groups, silicon oxide including SiO 19 and $SiO_2$ 20 and two types of metallic silicon such as 17 and 18. Since a simple substance of metallic silicon 17 has binding energy (BE) of 99 eV, metallic silicon 18 whose binding energy is slightly larger than it has a peak which is considered to be equivalent to silicide. As to Cr, chromium oxide 23 can be separated from metallic chromium 22, though more detailed peak separation is difficult. Therefore, silicide is not defined. However, it is clear from the Si peak that silicide exists. It shows that a resistor thin film of the present invention is formed from metallic chromium, metallic silicon, chromium silicide, silicon oxide, and chromium oxide. The composition of a resistor thin film of the present invention is obtained by this analysis and shown in FIG. 1. The range 1 is limited from the viewpoint that the resistivity of a resistor thin film ranges from $1\times10^3$ to $1\times10^6$ $\mu\Omega$.cm after heat treatment in consideration that the thin film is used as a thin film resistor and the absolute value of TCR is 1000 ppm or less. There are no problems imposed from the above thin film formation being performed within this range. According to the present invention, since changes in the resistivity at a high temperature can be controlled in an appropriate state, a resistor thin film which is stable in change with time and has a superior power resistance can be formed as a resistor element. A superior resistor element can be formed by selecting appropriate materials for an electrode metal and a migration resistant layer and can be used as a thermal head which is used under severe operation conditions. A resistor thin film of the present invention can be used as a resistor of a circuit which is durable, highly stable, and little degraded during operation.

What is claimed is:

1. A thin film resistor comprising metallic chromium, elemental silicon, chromium silicide, silicon oxide, and chromium oxide as necessary components.

2. A thin film resistor according to claim 1, wherein said thin film resistor is heat-treated in a vacuum during deposition at a temperature greater than 150°C.

3. A thin film resistor according to claim 1, wherein said thin film resistor is heat-treated in a vacuum after deposition at a temperature greater than 150° C. before forming another metalized layer as an electrode thereon.

4. A thin film resistor according to claim 1, wherein said thin film resistor is formed by sputtering deposition using a sputtering target containing chromium silicide.

5. A thin film resistor according to claim 2, wherein said thin film resistor is formed by sputtering deposition using a sputtering target containing chromium silicide.

6. A thin film resistor according to claim 3, wherein said thin film resistor is formed by sputtering deposition using a sputtering target containing chromium silicide.

7. A wiring board wherein a thin film resistor according to claim 1 is mounted as a component of an electric circuit.

8. Electronic equipment wherein one of wiring boards according to claim 7 is mounted.

9. A thin film resistor according to claim 4, wherein said sputtering target contains silicon and chromium in a mixing ratio of more than 2.

10. A thin film resistor according to claim 5, wherein said sputtering target contains silicon and chromium in a mixing ratio of more than 2.

11. A thin film resistor according to claim 6, wherein the sputtering target contains silicon and chromium in a mixing ratio of more than 2.

12. A thin film resistor according to claim 1, wherein said thin film resistor has a composition range designated by M in the Si-Cr-O ternary composition diagram shown in FIG. 4.

13. A thin film resistor according to claim 2, wherein said thin film resistor has a composition range designated by M in the Si-Cr-O ternary composition diagram shown in FIG. 4.

14. A thin film resistor according to claim 3, wherein said thin film resistor has a composition range designated by M in the Si-Cr-O ternary composition diagram shown in FIG. 4.

* * * * *